United States Patent [19]

Miyahara

[11] Patent Number: 4,516,931

[45] Date of Patent: May 14, 1985

[54] FUEL GASIFYING BURNER

[75] Inventor: Kingo Miyahara, Tokyo, Japan

[73] Assignee: Dowa Co., Ltd., Tokyo, Japan

[21] Appl. No.: 553,929

[22] Filed: Nov. 21, 1983

[30] Foreign Application Priority Data

Nov. 25, 1982 [JP] Japan ..... 57-206778

[51] Int. Cl.[3] ..... F23D 11/04

[52] U.S. Cl. ..... 431/168; 431/169; 239/214.25; 239/223

[58] Field of Search ..... 431/168, 169; 239/214, 239/25, 223, 224, 225; 60/744, 745

[56] References Cited

U.S. PATENT DOCUMENTS

| | | | |
|---|---|---|---|
| 4,386,905 | 6/1983 | Miyahara | 431/168 |

FOREIGN PATENT DOCUMENTS

| | | | |
|---|---|---|---|
| 2724124 | 12/1977 | Fed. Rep. of Germany | 431/168 |
| 16708 | 1/1982 | Japan | 431/168 |
| 87510 | 6/1982 | Japan | 431/168 |
| 127711 | 8/1982 | Japan | 431/168 |
| 169508 | 10/1982 | Japan | 431/168 |
| 188911 | 11/1982 | Japan | 431/168 |
| 188913 | 11/1982 | Japan | 431/168 |
| 188914 | 11/1982 | Japan | 431/168 |
| 11316 | 1/1983 | Japan | 431/169 |

*Primary Examiner*—Samuel Scott

*Assistant Examiner*—Brian J. Bowman

*Attorney, Agent, or Firm*—Pollock, Vande Sande & Priddy

[57] ABSTRACT

A fuel gasifying burner including a combustion cylinder, a rotary shaft extending into the combustion cylinder through its open base, a frustoconical rotary gasifying member connected to the rotary shaft and formed at a lower end of its wall with a bent portion extending outwardly and having at its peripheral end a liquid fuel scattering end, and an inner gasifying member located inside the rotary gasifying member to form a unit therewith and having connected to a lower end of its wall a fuel air-mixture gas diffusing wall extending outwardly a greater distance than the bent portion of the rotary gasifying member. The inner gasifying member is formed at its forward end with an air supply opening communicated through an air passage with an air blowing chamber. An annular flame ejecting upright wall is formed contiguous with a fuel-air mixture gas diffusing wall and provided at its end with a liquid fuel rescattering portion. When a fuel-air mixture gas is ejected through a gas ejecting passageway between the two gasifying members, the pressure under which the gas is ejected is reduced as the gas impinges on the flame ejecting upright wall, so that the gas can be diffused into the interior of the combustion cylinder in flames of reduced vigor.

6 Claims, 7 Drawing Figures

FUEL GASIFYING BURNER

BACKGROUND OF THE INVENTION

This invention relates to burners, and more particularly it is concerned with a fuel gasifying burner in which kerosene or other fuel in a liquid state is formed into atomized particles and burned during the initial stages of combustion, after which the burner shifts from combustion of the fuel in the liquid state to combustion of the fuel in a gasified state following vaporization of the liquid fuel by the heat of its combustion.

In one type of fuel gasifying burner known in the art, kerosene or other liquid fuel is formed into atomized particles by the rotary action of a frustoconical rotary gasifying member and the liquid fuel in atomized particles is vaporized into a gasified state inside the rotary gasifying member by the heat of combustion of the liquid fuel in atomized particles. As the liquid fuel is vaporized into a gaseous state, air is mixed with the gaseous fuel into a fuel-air mixture which is vigorously ejected through a fuel-air mixture passage formed at the edge of an open end of the rotary gasifying member. In this type of burner, it is essential that the volume of the liquid fuel formed into atomized particles at initial stages of combustion be maximized to enable ignition and initiation of combustion of the liquid fuel to take place quickly and positively, and that flames of combustion of the fuel in a gaseous state formed at initial stages of combustion of the gaseous fuel be directed as much as possible to the rotary gasifying member from outside to efficiently heat the rotary gasifying member. It is also essential that the fuel in the gasified state produced inside the rotary gasifying member mix sufficiently with air into a mixture of fuel and air for sustaining combustion of the gaseous fuel. The aforesaid requirements should be met for reducing the time required for the burner to shift from combustion of the fuel in the liquid state to combustion of the fuel in the gaseous state and for producing a fuel-air mixture in a volume large enough to sustain combustion, so that combustion of the gaseous fuel can be maintained in a stable manner over a prolonged period of time. In addition, if the pressure under which flames of the mixture of fuel and air are ejected is too low at the time of combustion of the fuel in the gaseous state, gas in a gas chamber would be ignited and combustion might start in the gas chamber, making it impossible for the burner to function as a fuel gasifying burner. To avoid this trouble, it is usual practice to raise the pressure under which the flames of the fuel-gas mixture are ejected to a level which is free from the risk of causing combustion of the gaseous fuel due to backfire. This has tended to raise the noise of combustion of the gasified fuel and made it impossible to obtain combustion in soft flames in quiet atmosphere.

The problems described hereinabove have not satisfactorily been solved in the prior art. Thus the fuel gasifying burner of the type described has suffered the following disadvantages. Ignition and combustion of the liquid fuel would not sometimes take place in good condition, thus interfering with shifting of the burner to combustion of the gaseous fuel. The major portion of the flames of combustion of the gaseous fuel would be ejected toward the combustion cylinder and unable to heat the rotary gasifying member sufficiently to enable a perfect fuel-air mixture to be generated continuously within the rotary gasifying member. The noise of combustion of the gaseous fuel might reach an inordinately high level and cause environmental disruption.

SUMMARY OF THE INVENTION

This invention has been developed for the purpose of obviating the aforesaid disadvantages of the prior art. Accordingly, the invention has as its object the provision of a fuel gasifying burner wherein a liquid fuel fed into the rotary gasifying member can be scattered a plurality of times to obtain maximization of atomization of the liquid fuel, to enable ignition and initiation of combustion of the liquid fuel in atomized particles to take place positively and to quickly and allow the burner to shift from a condition of combustion of the liquid fuel to a condition of combustion of a gaseous fuel in a reduced period of time. The gasified fuel produced inside the rotary gasifying member can be made to flow in a vortical stream after mixing with air to enable the gaseous fuel and air to be throughly agitated to obtain a satisfactory mixture, and flames of combustion of the gaseous fuel ejected from the rotary gasifying member can be concentratedly directed to the outer periphery of the rotary gasifying member to enable the mixture of gaseous fuel and air to be continuously produced in a stable manner in a quantity large enough to sustain combustion of the gaseous fuel over a prolonged period of time. The mixture of gaseous fuel and air vigorously ejected from the rotary gasifying member under high pressure impinges on an obstacle and has its pressure reduced quickly and changes the direction of its flow so that flames can be directed inwardly in the combustion chamber and diffused while having its vigor decreased, to avoid production of noises of a high level at the time combustion of the gaseous fuel is carried out.

DESCRIPTION OF THE PREFERRED EMBODIMENTS

Preferred embodiments of the invention will now be described by referring to the accompanying drawings.

Figure 1:
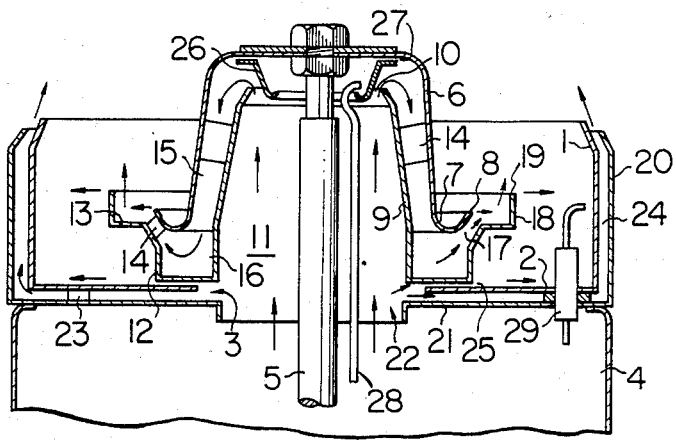
FIG. 1 is a vertical sectional front view, with certain parts being cut out, of the fuel gasifying burner comprising a first embodiment of the invention.

Referring to FIG. 1, a combustion cylinder 1 open at its forward end has a bottom wall 2 formed near its center opening with air supply port 3. An air blowing chamber 4 is located adjacent the bottom wall 2 and maintained in communication with the interior of the combustion cylinder 1 and supports at its forward end a frustoconical rotary gasifying member 6 closed at its forward end and open at its base. The frustoconical rotary gasifying member 6 has its wall bent outwardly as indicated at 7 near its base to provide a wall end portion serving as a liquid fuel scattering portion 8. The frustoconical rotary gasifying member 6 has an inner gasifying member 9 connected thereto to function as a unit therewith, with walls of the two gasifying members 6 and 9 being spaced apart from each other by a plurality of spacer plates 14. The inner gasifying member 9 is formed at its forward end with an air supply opening 10 and its interior serves as an air passage 11 which is maintained in communication at the base of the inner gasifying member 9 with the air supply port 3 formed substantially in the central portion of the bottom wall 2 of the combustion cylinder 1. The inner gasifying member 9, which is also frustoconical in shape, has an extension of its wall at its open base which includes a bent portion 12 directed toward the bent portion 7 of the wall of the frustoconical rotary gasifying member 6 near its base, and a substantially flat portion 13, contiguous with the bent portion 12 extending further outwardly of the bent portion 7 of the wall of the frustoconical gasifying member 6 near its open base, which serves as a fuel-air mixture gas diffusing wall. Thus the two gasifying members 6 and 9 define between an inner wall surface of the former and an outer wall surface of the latter a fuel-air mixture passage 15, a gas chamber 16 and a gas ejecting passageway 17 arranged in the indicated order from the forward end of gasifying members 6 and 9 toward the base thereof and maintained in communication with one another. Contiguous with the fuel-air mixture gas diffusing wall 13 is a flame ejecting upright wall 18 which is annular in shape and provided at its peripheral end with a liquid fuel rescattering end 19. A fuel-air mixture gas stream ejected in vortical flow through the gas ejecting passageway 17 which is inclined toward the open forward end of the combustion cylinder 1 impinges on the flame ejecting up-right wall 18 and flows diffusingly along the fuel-air mixture gas diffusing wall 13 while the pressure under which the fuel-air mixture gas stream flows in flames is reduced, so that the flames of combustion of the air-fuel mixture gas can be directed forwardly, and the liquid fuel scattered in atomized particles from the liquid fuel scattering portion 8 of the frustoconical rotary gasifying member 6 impinges on the flame ejecting upright wall 18 and is scattered from the liquid fuel rescattering end 19 toward an inner wall surface of the combustion cylinder 1 in particles of further reduced size.

Located outside the combustion cylinder 1 is an outer cylindrical member 20 connected to the combustion cylinder 1 to form a unit therewith through spacer plates 23. The outer cylindrical member 20 is open at its forward end and has a bottom wall 21 formed at its central portion with an air supply opening 22 communicating with the air supply port 3 and air passage 11. Defined between an outer wall surface of the combustion cylinder 1 and an inner wall surface of the outer cylindrical member 20 is a cooling air passageway 24 open at its forward end communicated at its base with the air blowing chamber 4 via the air supply opening 22.

An air ejecting passageway 25 is defined between the bent portion 12 of the wall of the inner gasifying member 9 located near its base and the bottom wall 2 of the combustion cylinder 1 for forcedly blowing air into the interior of the combustion cylinder 1.

The numeral 26 designates a hollow fuel scattering member in the form of an inverted cone secured to the frustoconical rotary gasifying member 6 in such a manner that its base is located in spaced apart relation to a central portion of an inner surface of the forward end of the member 6 with a liquid fuel scattering gap 27 defined therebetween. A fuel supply line 28 has its forward end open on an inner surface of a lower portion of the fuel scattering member 26. The numeral 29 designates an ignition plug.

In the fuel gasifying burner of the aforesaid construction, it is possible to eject a stream of mixture of gaseous fuel and air in a direction in which it is substantially perpendicular to the flame ejecting upright wall 18 by simply modifying the construction of the bent portion 7 of the wall of the frustoconical rotary gasifying member 6 near its open base, to thereby cause the stream of mixture of gaseous fuel and air effectively to impinge on the flame ejecting upright wall 18 and be diffused by the fuel-air mixture gas diffusing wall 13. This is conducive to combustion of the fuel-gas mixture in soft flames at a low noise level.

Figure 2:
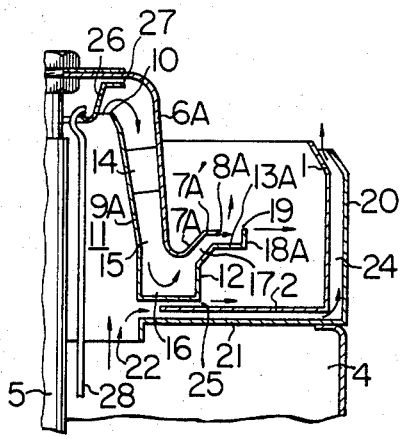
FIG. 2 is a vertical sectional front view, with certain parts being cut out, of the fuel gasifying burner comprising a second embodiment.

FIG. 2 shows a second embodiment of the fuel gasifying burner in conformity with the invention in which a bent portion 7A of a wall of a frustoconical rotary gasifying member 6A near its open base which extends in a curve toward the open end of the combustion cylinder 1 has a forward end portion 7A' extending substantially horizontally in a direction which is substantially perpendicular to a flame ejecting upright wall 18A. The forward end portion 7A' terminates at an end serving as a liquid fuel scattering end 8A. In the second embodiment of the fuel gasifying burner of the aforesaid construction, a mixture of gaseous fuel and air ejected vigorously through the gas ejecting passageway 17 flows along the forward end portion 7A' and impinges at a direct angle on the flame ejecting upright wall 18A. When it impinges on the wall 18A, the mixture of gaseous fuel and air has the pressure under which it is ejected greatly reduced, and following impingement, the mixture flows along a fuel-air mixture gas diffusing wall 18A to be diffused toward an outer periphery of the frustoconical rotary gasifying member 6A. Thereafter, the fuel-air mixture gas burns in flames which are soft and directed forwardly.

Figure 3:
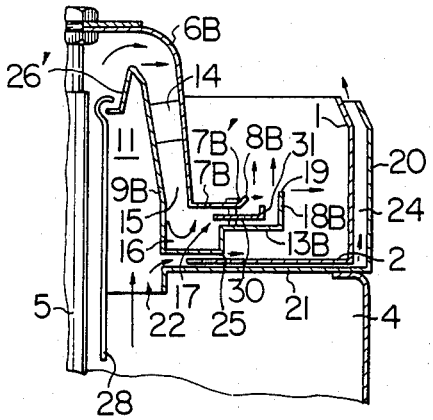
FIG. 3 is a vertical sectional front view, with certain parts being cut out, of the fuel gasifying burner comprising a third embodiment.

FIG. 3 shows a third embodiment in which a bent portion 7B of a wall of a frustoconical rotary gasifying member 6B near its open end extends in a direction which is substantially perpendicular to a flame ejecting upright wall 18B, and its end portion slightly extends toward the open forward end of the combustion cylinder 1 and a tilting upright wall 7B' is formed integrally therewith while a forward end of the tilting upright wall 7B' is made to function as a liquid fuel scattering end 8B. The gas ejecting passageway 17 opening in a direction substantially perpendicular to the flame ejecting upright wall 18B is divided by an annular partition plate 30 formed at its peripheral end with an auxiliary upright wall 31 into two portions to divide a stream of fuel-air mixture gas into two substreams which impinge on the flame ejecting upright wall 18B and the auxiliary upright wall 31 respectively, to further reduce the pressure under which the fuel-air mixture gas is ejected and cause flames of combustion of the gaseous fuel to be ejected forwardly in the form of a ring in quiet atmosphere with a low noise level. In the embodiment of the fuel gasifying burner of the aforesaid constructional form, the fuel scattering member 26 shown in FIG. 2 can be dispensed with and a forward end portion of the wall of the inner gasifying member 9 is bent downwardly inwardly into an inverted conical shape serving as a fuel scattering member 26', thereby enconomizing on the number of parts and promoting atomization of the liquid fuel.

Figure 4:
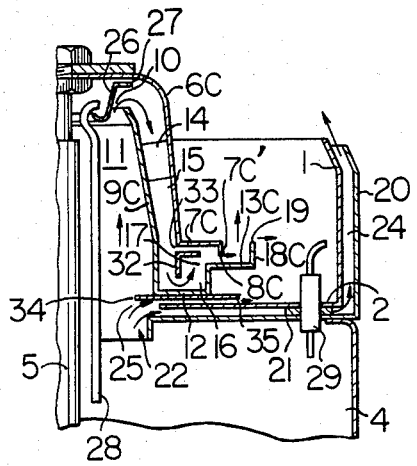
FIG. 4 is a vertical sectional front view, with certain parts being cut out, of the fuel gasifying burner comprising a fourth embodiment.

FIG. 4 shows a fourth embodiment in which a bent portion 7C of a wall of a frustoconical rotary gasifying member 6C near its open base extends in a direction which is substantially perpendicular to a flame ejecting upright wall 18C and has at its forward end a downwardly bent wall 7C directed toward a fuel-air mixture gas diffusing wall 13C and having an end serving as a liquid fuel scattering end 8C. In this constructional form, the pressure under which the mixture of fuel gas and air is ejected can be effectively reduced and diffusion of the mixture of fuel gas and air can be satisfactorily achieved even if the flame ejection upright wall 18C is small in height while scattering of the liquid fuel from the liquid fuel scattering end 8C toward the flame ejecting upright wall 18C can be positively obtained. In this embodiment, a hollow cylindrical air mixing member 32 may be mounted in the gas chamber 16 in such a manner that its base is spaced apart by a fuel gas flowing gap 33 from an inner surface of the bent portion 7C of the wall of the frustoconical rotary gasifying member 6C near its open base. The provision of the air mixing member 32 enables a satisfactory mixture of gaseous fuel and air to be obtained by expediting the agitation and mixing of the gaseous fuel and air flowing through the fuel gas flowing gas 33. In this embodiment, the bent portion 12 of an inner gasifying member 9C has attached to the inside and outside of its bottom surface guide walls 34 and 35 respectively which are parallel to the bottom wall 2 of the combustion cylinder 1, to enable a portion of an air stream forcedly fed from the air blowing chamber 4 to flow positively through the air ejecting passageway 25.

Figure 5:
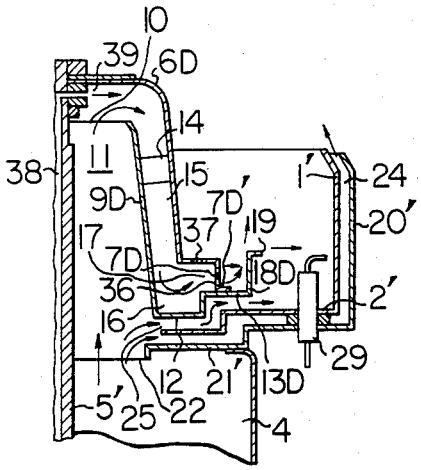
FIG. 5 is a vertical sectional front view, with certain parts being cut out, of the fuel gasifying burner comprising a fifth embodiment.
Figure 6:
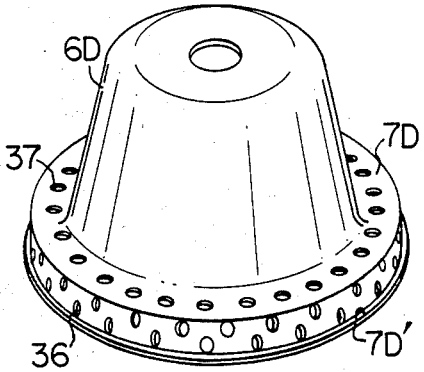
FIG. 6 is a perspective view of the rotary gasifying member of the fifth embodiment of the fuel gasifying burner shown in FIG. 5.

In the fifth embodiment of the fuel gasifying burner in conformity with the invention shown in FIGS. 5 and 6, a bent portion 7D of a wall of a frustoconical rotary gasifying member 6D near its open base extends toward a flame ejecting upright wall 18D, and its end is downwardly bent toward a fuel-air mixture gas diffusing wall 13D to provide an annular wall 7D' which is connected at its end to a top surface of the fuel air mixture gas diffusing wall 13D. The annular wall 7D' is formed therein with a multiplicity of flame ejecting apertures 36 through which the fuel can be scattered toward the flame ejecting upright wall 18D or a fuel-air mixture gas produced can be ejected toward the flame ejecting upright wall 18D, and the bent portion 7D of the wall of the member 6 near its open base directed toward the flame ejecting upright wall 18D is formed with a multiplicity of auxiliary flame ejecting apertures 37 in a suitable number for allowing a portion of the fuel-air mixture gas to be ejected in flames toward the outer periphery of the frustoconical rotary gasifying member 6D. By this arrangement, it is possible to enable combustion of the gasified fuel to take place in quiet atmosphere while efficiently heating the frustoconical rotary gasifying member 6D. In this embodiment, a combustion cylinder 1' and an outer cylindirical member 20' have their bottom walls 2' and 21' respectively formed substantially in the same shape as the bent portion 7D of the wall of an inner cylindrical member 9D, and a rotary shaft 5' is hollow and has a fuel supply passageway 38 formed therein and opening at an oil ejecting port 39 formed at a forward end of the rotary shaft 5' for scattering the liquid fuel on to an inner peripheral surface of the rotary gasifying member 6D.

Figure 7:
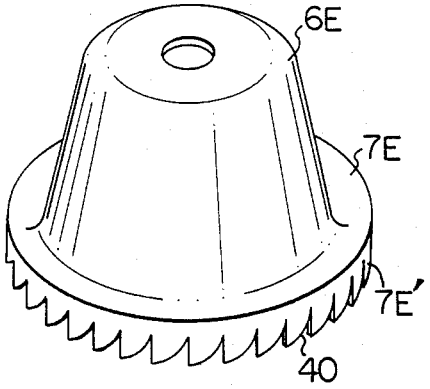
FIG. 7 is a perspective view of another embodiment of the rotary gasifying member shown in FIG. 6.

FIG. 7 shows a further modification 6E of the frustoconical rotary gasifying member of the fuel gasifying burner according to the invention, in which a bent portion 7E of a wall of the frustoconical rotary gasifying member 6E rear its open base extends toward a flame ejecting upright wall, not shown and its end is bent downwardly to provide an annular wall 7E' which is brought into abutting relation to fuel-air mixture gas diffusing wall, not shown. The annular wall 7E' is formed at its end portion with a multiplicity of cutouts 40 to allow the liquid fuel or the mixture of gaseous fuel and air to flow therethrough toward the flame ejecting upright wall 18 in the form of scattered atomized particles of liquid fuel or flames of combustion of gaseous fuel, to allow the burner to positively shift from combustion of liquid fuel in atomized particles to combustion of gaseous fuel.

Operation of the fuel gasifying burner according to the invention will now be described.

Referring to FIG. 1, when the rotary shaft 5 is driven for rotation, the frustoconical rotary gasifying member 6 and the inner cylindrical member 9 formed unitarily with the rotary shaft 5 begin to rotate at high speed. By feeding air forcedly in a current through the air supply opening 22 into the air passage 11 from the air blowing chamber 4, the air current is introduced through the air supply opening 10 of the inner gasifying member 9 into the fuel-air mixture passage 15, from which it flows via the gas chamber 16 to be vigorously ejected through the gas ejecting passageway 17 toward the flame ejecting upright wall 18. Meanwhile a portion of the air current forcedly directed through an air supply opening 22 to the air passage 11 flows through a cooling air passage 24 and an air ejecting passageway 25, so as to thereby cool the combustion cylinder 1 from inside and outside and at the same time form an air curtain of forced supply of air on the side of the bottom wall 2 of the combustion cylinder 1.

Then, a liquid fuel is supplied through the fuel supply line 28 to the inner surface of the fuel scattering member 26. The liquid fuel thus supplied is diffused on the inner surface of the fuel scattering member 26 and ejected through the liquid fuel scattering gap 27 toward the inner wall surface of the frustoconical rotary gasifying member 6 at its forward end portion. The liquid fuel ejected on to the inner wall surface of the gasifying member 6 is dispersed into atomized particles as it flows from the forward end portion of the member 6 toward its base while the member 6 rotates at high speed, until it is scattered from the liquid fuel scattering end 8 of the wall of the member 6 toward the flame ejecting upright wall 18. The liquid fuel thus scattered is scattered again from the liquid fuel rescattering end 19 at the forward end of the flame ejecting upright wall 18 into the interior of the combustion cylinder 1 where it is ignited by means of the ignition plug 29. The liquid fuel supplied in this way is subjected to a diffusing action and an ejecting action several times while it is scattered into the interior of the combustion cylinder 1, so that the liquid fuel can be turned into superatomised particles enabling combustion of the liquid fuel to be initiated quickly and positively.

Flames of combustion of the liquid fuel in atomized particles taking place inside the combustion cylinder 1 heat not only the frustoconical rotary gasifying member 6 but also the inner gasifying member 9. As a result, liquid fuel supplied through the fuel supply line 28 to the fuel scattering member 26 and scattered thereby on to the inner wall surface of the rotary gasifying member 6 is vaporized into gaseous fuel as it spreads out in all directions. The gaseous fuel produced in this way is agitated while flowing in vortical stream in an air current forcedly flowing through the fuel-air mixture passage 15 and mixed with air as the rotary gasifying member 6 and inner gasifying member 9 rotate, to produce a good mixture of gaseous fuel and air which is introduced under pressure into the gas chamber 16. From the gas chamber 16, the fuel-air mixture is vigorously ejected under high ejecting pressure through the gas ejecting passageway 17 toward the flame ejecting upright wall 18 and ignited by the flames of combustion of liquid fuel already formed as described hereinabove, to thereby produce flames of combustion of the mixture of gaseous fuel and air.

When the gaseous fuel burns, the mixture of gaseous fuel and air vigorously ejected under high pressure through the gas ejecting passageway 17 impinges on the flame ejecting upright wall 18 without fail and has its pressure reduced by the impingement. In addition, the mixture of gaseous fuel and air impinging on the wall 18 changes the direction of its flow toward the outer wall surface of the rotary gasifying member 6 and is diffused along the fuel-air mixture gas diffusing wall 13. Thus the flames of combustion of the mixture of gaseous fuel and air are soft and only produce a low level of noise of combustion while heating the rotary gasifying member 6 with a high degree of efficiency.

After the burner has shifted from combustion of the liquid fuel to combustion of the gaseous fuel, the rotary gasifying member 6 can be effectively heated and the mixture of gaseous fuel and air can be produced in volumes large enough to maintain combustion of the gaseous fuel, so that flames of combustion of the gaseous fuel can be produced continuously in a quiet atmosphere over a prolonged period of time.

From the foregoing description, it will be appreciated that the features of the invention described in detail hereinabove enable the liquid fuel to be scattered several times by the rotary action of the rotary gasifying member 6 and the inner gasifying member 9 when the burner is started to form the liquid fuel into atomized particles to permit ignition and combustion of the liquid fuel to take place quickly and positively so that the burner will shift quickly from a condition of combustion of the liquid fuel to a condition of combustion of the gaseous fuel, and that the features also enable the gaseous fuel produced by varporization of the liquid fuel to be agitated and mixed well with air in the fuel air-mixture passage 15 where it flows in vortical stream as the rotary gasifying member 6 and inner gasifying member 9 rotate, so that a good mixture of gaseous fuel and air can be ejected through the gas ejecting passageway 17 to permit combustion of the gaseous fuel to be sustained stably. Additionally, the mixture of gaseous fuel and air ejected through the gas ejecting passageway 17 under high pressure impinges on the flame ejecting upright wall 18 as soon as it is ejected and has its pressure greatly reduced before being dispersed toward the outer wall surface of the rotary gasifying member 6 along the fuel-air mixture gas diffusing wall 13. Thus the invention can achieve the effects of reducing the level of noise of combustion when the gaseous fuel is burned and heating the rotary gasifying member 6 with a high degree of efficiency, with a result that the burner can be maintained in the condition of combustion of the gaseous fuel stably and without any trouble over a prolonged period of time.

What is claimed is:

1. A fuel gasifying burner comprising:

a combustion cylinder open at one end and closed at the other end, said other end being formed substantially at its central portion with an air supply port;

a rotary shaft extending through said air supply port into said combustion cylinder;

a frustoconical rotary gasifying member closed at its forward end and open at its base, said frustoconical rotary gasifying member being rotatably mounted in said combustion cylinder and connected to said rotary shaft and formed at a lower end of its wall with a bent portion extending outwardly from said lower end of said wall and having at its peripheral end a liquid fuel scattering end;

an inner gasifying member of frustoconical shape formed at its forward end with an air supply opening and in its interior with an air passage maintained in communication through said air supply port with an air blowing chamber connected to a base of said inner gasifying member, said inner gasifying member being located inside said frustoconical rotary gasifying member and connected thereto to form a unit therewith and having connected to a lower end of its wall a fuel-air mixture gas diffusing wall extending outwardly a greater distance than said bent portion at said lower end of said wall of said frustoconical rotary gasifying member;

a fuel-air mixture passage, a gas chamber and a gas ejecting passageway defined between an inner wall surface of said frustoconical rotary gasifying member and an outer wall surface of said inner gasifying member and arranged in the indicated order from said forward end of said frustoconical rotary gasifying member toward said base of said inner gasifying member; and an annular flame ejecting upright wall contiguous with said fuel-air mixture gas diffusing wall connected to the lower end of the wall of the inner gasifying member and formed at its forward end with a liquid fuel rescattering end, said flame ejecting upright wall being operative when said mixture impinges thereon to reduce the pressure under which said fuel-air mixture gas is ejected through said gas ejecting passageway, whereby said mixture can be diffused into the interior of said combustion cylinder in flames of reduced vigor.

2. A fuel gasifying burner as claimed in claim 1, wherein said bent portion at said lower end of said wall of said frustoconical rotary gasifying member further extends substantially horizontally in a direction substantially perpendicular to said flame ejecting upright wall and provides at its end a liquid fuel scattering end.

3. A fuel gasifying burner as claimed in claim 1, wherein said bent portion at said lower end of said wall of said frustoconical rotary gasifying member extends straightforwardly in a direction substantially perpendicular to said flame ejecting upright wall and its peripheral end portion is directed slightly obliquely upwardly toward said one end of said combustion cylinder to provide an inclined wall forward integrally therewith and having a forward end serving as a liquid fuel scattering end, and wherein said gas ejecting passageway opening in a direction substantially perpendicular to said flame ejecting upright wall is divided into two portions by an annular partition plate having an auxiliary upright wall at its peripheral end to render the gas flow in two streams which impinge respectively on the flame ejecting upright wall and the auxiliary upright wall, to reduce the pressure under which the gas is ejected and allow the gas to spread between the auxiliary upright wall and the flame ejecting upright wall so that ring-shaped flames of combustion of the fuel-air mixture gas can be directed forwardly at a low noise level.

4. A fuel gasifying burner as claimed in claim 1, wherein said bent portion at the lower end of the wall of said frustoconical rotary gasifying member extends straightforwardly in a direction substantially perpendicular to said flame ejecting upright wall and its peripheral end portion is directed downwardly toward the fuel-air mixture gas diffusing wall to provide a bent wall formed at its end with a liquid fuel scattering end.

5. A fuel gasifying burner as claimed in claim 1, wherein said bent portion at the lower end of the wall of said frustoconical rotary gasifying member extends straightforwardly in a direction substantially perpendicular to said flame ejecting upright wall and its peripheral end portion is downwardly bent toward the fuel-air mixture gas diffusing wall to provide an annular wall, and wherein said annular wall is connected at its end to said fuel-air mixture gas diffusing wall and formed with a multiplicity of flame ejecting apertures for scattering liquid fuel therethrough toward the flame ejecting upright wall or ejecting the fuel-air mixture gas produced therein toward the flame ejecting upright wall.

6. A fuel gasifying burner as claimed in claim 5, further comprising a suitable number of auxiliary flame ejecting apertures formed at a flat surface of said bent portion of said lower end of said wall of said frustoconical rotary gasifying member, to direct a portion of the fuel-air mixture gas in flames toward the outer wall surface of said frustoconical rotary gasifying member.

* * * * *